US007694806B2

(12) United States Patent
Huggins

(10) Patent No.: US 7,694,806 B2
(45) Date of Patent: Apr. 13, 2010

(54) ARTIST'S PAINT BOX SYSTEM

(76) Inventor: Winston Huggins, 584 Cleveland St., Brooklyn, NY (US) 11208

( * ) Notice: Subject to any disclaimer, the term of this patent is extended or adjusted under 35 U.S.C. 154(b) by 205 days.

(21) Appl. No.: 11/618,842

(22) Filed: Dec. 31, 2006

(65) Prior Publication Data

US 2008/0156667 A1 Jul. 3, 2008

(51) Int. Cl.
*B44D 3/00* (2006.01)
*B44D 3/04* (2006.01)

(52) U.S. Cl. ..... 206/1.7; 206/1.8; 206/575; 248/447

(58) Field of Classification Search ..... 206/1.7, 206/1.8, 1.9, 81, 575; 248/447
See application file for complete search history.

(56) References Cited

U.S. PATENT DOCUMENTS 654,841 A * 7/1900 Sabin-MacDonald ..... 312/231
2,638,397 A * 5/1953 Wykoff ..... 312/231
2,676,428 A * 4/1954 Silver ..... 206/1.7
2,711,605 A * 6/1955 Dripps ..... 206/1.7
2,751,271 A * 6/1956 Dessertenne et al. ..... 312/231
3,023,884 A * 3/1962 Schwartz ..... 206/1.7
3,168,363 A * 2/1965 Monsour ..... 312/231
3,540,787 A * 11/1970 Ford ..... 312/231
3,669,227 A * 6/1972 Alford ..... 190/11
3,732,972 A * 5/1973 Israel ..... 206/1.7
4,093,326 A * 6/1978 Ford ..... 312/231
4,129,213 A * 12/1978 Fleig ..... 206/575
4,335,812 A * 6/1982 Koves ..... 206/1.8
4,372,630 A * 2/1983 Fuhri ..... 312/231
4,638,909 A * 1/1987 Ford ..... 206/1.7
6,095,682 A * 8/2000 Hollander et al. ..... 374/121
6,619,474 B2 * 9/2003 Montgomery ..... 206/1.9
6,923,332 B1 * 8/2005 Thomas ..... 215/11.1
7,401,410 B1 * 7/2008 Jewell ..... 33/1 K
2003/0196408 A1 * 10/2003 Weder ..... 53/218
2005/0218011 A1 * 10/2005 Dewitt ..... 206/1.7
2005/0263999 A1 * 12/2005 English et al. ..... 281/22

* cited by examiner

*Primary Examiner*—Mickey Yu
*Assistant Examiner*—Sharon M Prange
(74) *Attorney, Agent, or Firm*—Harvey Lunenfeld

(57) ABSTRACT

An artist's paint box comprising: a substantially parallelepiped box having an interior chamber, combination hinged easel and cover, and storage compartment having a hinged cover; a removably replaceable palette matingly received within the chamber and having opposing cutouts substantially parallel to each other and another cutout transverse to the opposing cutouts, the opposing cutouts and the transverse cutout forming a substantially U shape, a recessed paint color mixing area substantially centrally disposed between and adjacent the opposing cutouts and adjacent the transverse cutout, and a recessed paintbrush and tool holding area adjacent the transverse cutout and opposing the recessed paint color mixing area; removably replaceable paint wells removably and matingly received within the opposing cutouts and the transverse cutout, each of the removably replaceable paint wells having exteriorly disposed opposing side ridges resting on opposing edges adjacent each of the opposing cutouts and other opposing edges adjacent the transverse cutout.

19 Claims, 13 Drawing Sheets

ARTIST'S PAINT BOX SYSTEM

BACKGROUND OF THE INVENTION

1. Field of the Invention

The present invention relates generally to artists' paint boxes and more particularly to artists' paint boxes having removably replaceable palettes.

2. Background Art

There is a need for an artist's paint box system that can be used for watercolor, oil, acrylics, and pastels, that is portable, that may be carried in one hand or removably fastened to a user's wrist or waist, has removably replaceable paint wells, has a removably replaceable palette that is adapted to hold the removably replaceable paint wells, has storage space for a variety of canvases and other materials to paint on and storage space for paintbrushes, has a removably replaceable viewfinder, has a hinged easel for quickly and conveniently mounting and removing canvases and materials to be painted on, and may be removably fastened to a variety of tripods and stands.

The artist's paint box system should allow for mixing of a variety of different paints and types of paints quickly, efficiently, and easily, with a minimum of waste. The artist's paint box system should allow for mounting and removal of canvases and other materials to be painted on quickly and easily, and should be capable of display, access, and retrieval of paintbrushes and tools in a quick, convenient, and efficient manner. Paints, paintbrushes, and tools should be capable of being displayed and distinguished one from the other quickly and easily, and being accessed, used, removed, and stored quickly, and easily. The artist's paint box should be durable, light weight, easy to carry, inexpensive, safe to use, attractive, sturdy, and of simple construction.

Different artist's paint boxes and paint systems have heretofore been known. However, none of the artist's paint boxes or paint systems adequately satisfies these aforementioned needs.

U.S. Pat. No. 5,399,009 (Hiner) discloses a transportable easel contained within a box that holds a workpiece support and tray for paints and brushes. A detachable wheeled tripod support folds up against the box for storage, and may be used to roll the box and collapsed easel to a desired location.

U.S. Pat. No. 6,772,987 (Jones, II) discloses a portable easel assembly that includes a paint/sketch box, having a base and lid connected by a hinge assembly. The base defines a cavity for storing art supplies, and the lid is configured to support a painting surface. The base and lid are inter-connected with a slide bar assembly. Use of the slide bar assembly and hinge assembly enable the lid to be secured in a number of positions. Preferably, first, second and third legs of adjustable length are pivotally attached to the base and moveable between folded positions and extended, supportive positions U.S. Pat. No. 4,093,326 (Ford) discloses an artist's kit, comprising a box and a pivotally mounted cover. The box can be secured to a mounting surface, by use of mounting members to provide a stable support for the kit when in use. The cover is capable of being secured in a plurality of open positions, and a head clamp and bottom support releasably mount the canvas to the cover during use. The head clamp and bottom support may be reversely mounted for transporting the canvas.

U.S. Pat. No. 4,372,630 (Fuhri) discloses a portable easel device, which serves alternatively as an easel and as a drawing board, and which provides a carrying case for art supplies and the components of the easel and support legs. The easel can be set up in the lower section of the case, and is supported by a rigid triangular framework formed by the upper and lower sections of the case and a folding easel arm. The drawing board is located on the upper section. A reversible hinge arrangement permits the hinge connection between the upper and lower sections to be reversed for drawing. Compartments within the upper and lower sections make the art supplies accessible for painting and drawing supplies accessible for drawing. The legs can be broken down for storage in the case, and have a male-female joint for increased strength and stability.

U.S. Pat. No. 4,856,856 (Winstone) discloses a portable artist's supply box and easel, which includes a permanent easel that also serves as a handle, by which the device is carried and transported. A second foldable and removable easel is also provided as a greater supporting easel surface. The second, removable easel is stored, when not used in a special compartment of the device. The device includes other compartments and drawers for storage of supplies, material, and tools. In a second embodiment, the device is designed for support on a bed, for use by bed-ridden and infirm persons in hospitals or homes, or for children.

U.S. Pat. No. 4,809,892 (Chinski, et al.) discloses an artist's kit that includes an easel, a bench, and a storage compartment unit. The easel includes three legs, which may be disassembled into leg segments. The seat includes detachable legs and a storage compartment. The easel leg segments and the detachable bench legs may be stored in the storage compartment of the seat. The storage compartment unit includes a plurality of pockets, for storing various artist's painting and drawing supplies. The storage compartment also includes a cover and a plurality of straps, for securing the storage compartment and cover to the seat bushings, when the seat is disassembled. The storage compartment unit further includes a plurality of straps, whereby the seat, easel, and storage compartment unit may be carried as a unitary back pack. A canvas carrying apparatus is provided for transporting a framed canvas on the back pack.

U.S. Pat. No. 3,954,314 (Crawford) discloses a paint box and easel combination, in which an easel base having a compartment for paint tubes and also brushes has a central rib formed with notches. A detachable lid for the base functions as a palette. Hinged to the front edge of the base is an upright member having a bail, which fits into any of the rib notches through the base center to adjust the angle of the easel upright relative to a tray. A transverse first channel is fixed to the hinged upright member. An easel extension slides in the upright socket, and is fixed in extension by the painting. Slidable on the bar is a second channel, which is adjusted in position by a thumb screw. A canvas or other painting surface is supported at its bottom and top edges by the first and second channels. For transportation and storage, the palette lid is placed on the tray, holding the contents in their compartments. The top easel cross bar is inverted and moved down to engage the edge of the palette and base, locking the palette and box closed, thus holding both paints and brushes in the base. The total configuration offers the artist a single compact package for all his or her painting needs.

U.S. Pat. No. 5,655,651 (Maier) discloses a palette and easel assembly, in which an easel is pivotally attached to a palette about an axis by at least one hinge. According to a first embodiment, an extensible member is detachably attached to the palette, and includes a first retracted position and a second extended position, wherein the extensible member substantially extends to the rear of the palette in the second position. A brace having a slot is detachably attached at one end thereof to an end of the extensible member disposed furthest to the rear of the palette, and is detachably attached at a remaining end thereof to the easel. A pair of thumbscrews pass through the slot at opposite ends thereof, and are used to tighten the brace to the extensible member and to the easel, thereby securing the easel in a desired position with respect to the palette. According to a second embodiment, a pivot member is pivotally attached to the palette, and includes a first position, wherein the pivot member is disposed under the palette, and a second position, wherein the pivot member substantially extends to the rear of the palette. A bracket having a U-shaped slot on one end thereof secures the pivot member in position in the second position, and a modified brace is detachably attached to the pivot member and to the easel.

U.S. Pat. No. 5,348,144 (Maier) discloses an artist sketch box that includes a bottom with upstanding walls attached to the bottom generally about the perimeter forming a base compartment, diagonal members affixed within the base compartment further defining an area therein, a lid assembly of approximately the same peripheral configuration as the base compartment hinged to one of the upstanding walls, and as having lid walls attached to the lid assembly adapted for receiving one or more artist panels and a panel board member hinged to the lid assembly to provide access for inserting or removing the artist panels from the lid assembly. The lid assembly pivots about its hinges, so that the lid walls and panel board member align with the upstanding walls to form a box. A lightweight easel and palette assembly is provided that fits within the box, and is removable separate and apart from the box for use. The easel and palette assembly includes a palette base assembly that is hinged to an easel assembly, which is adapted for receiving an artist panel board. The palette base assembly and easel assembly pivot with respect to each other, and are secured in position by a slotted brace and thumbscrew. The easel and palette assembly are either hand held by the artist, during use, or are affixed to a camera type of tripod.

U.S. Pat. No. 6,206,183 (Helsel) discloses a painter's box that includes provisions for painter's supplies, and which is supportable on an easel, the box including both a base and lid, the base including opposed top and bottom portions interconnected by opposed side portions, the bottom portion being provided with a groove for interconnection with an easel, the lid including a female connection area for interlocking with a male connector mounted on the easel.

U.S. Pat. No. 6,308,925 (Wilcox) discloses an adjustable paint box and easel, which folds into a portable box shape for carrying. A tripod head assembly allows outer legs to rotate out, middle leg to rotate down, paint holder assembly to rotate up, and the paint box to open, forming a painter's easel.

U.S. Pat. No. 5,337,996 (Kalish) discloses a portable easel system that includes a lightweight structure for oil and acrylic painting, which converts to a self-contained backpack, capable of transporting a canvas, paint supplies, and the like. The structure is composed of three legs joined at the top, braced by a detachable pack frame suspended between the legs near the middle, with each adjacent pair of legs crossbraced by flexible non-resilient cords between the bottom of each leg and the approximate junction between each adjacent leg and the pack frame. The system includes a pallet, solvent jar, and brush racks, all suspended from the pack frame exterior. Paint supplies are held and accessible from the painting position in front. The tripod and pack can be used separately, as easel and paint box.

U.S. Pat. No. 3,669,227 (Alford) discloses an artist's carrying case and easel. The artist's carrying case is characterized by a partitioned rectangular box, having a top compartment closed by a lid, which may be angularly elevated to form an easel and also provide access to the top compartment. A second partition forms a lower compartment, which is accessible through a slot, closed by a slidably removable bar, which is then secured to the face of the easel. Foldable legs with nesting angle braces are disposed adjacent the second partition, when the case is being transported.

U.S. Pat. No. 6,745,988 (Gelfand) discloses a workstation attachment for a french easel that has hinged tray halves, which, when open, have slides which engage the sides of the easel drawer from the exterior, and, thus, hold the tray open, so that the tray does not obstruct access to the interior of the drawer, while providing a place to rest a palette. On another side, the tray may form a brush rack and towel holder.

U.S. Pat. No. 4,318,471 (Hutton) discloses an artist's lap easel constructed of a number of flat rectangular panels, which are hingedly joined together, so that they can be folded flat one upon another, when not in use, and opened up to provide a tilted easel surface with an adjoining horizontal palette surface to one side of the easel. A portion of a supporting panel can be tilted upwardly and separably fastened to the easel to support it, when tilted, and a portion of the palette section can be similarly upwardly tilted, the tilted portion being provided with at least one pocket for supplies. At least one of the panels includes a cutout portion to serve as a carrying handle.

U.S. Pat. No. 3,540,787 (Ford), U.S. Pat. No. 3,378,322 (Johnson), and U.S. Pat. No. 2,751,271 (Dessertenne, et. al.) disclose a combined artist's paint box and easel, an artist's kit and easel support, and a combined box and easel for painting in the open country, respectively.

U.S. Pat. No. 3,202,471 (Wilson), U.S. Pat. No. 815,810 (Goldsworthy), and U.S. Pat. No. 654,841 (Sabin-MacDonald) disclose an artist's box, easel and table, an adjustable artist's desk and easel, and an easel and artist's cabinet, respectively.

U.S. Pat. No. 3,168,363 (Monsour), U.S. Pat. No. 3,132,439 (McGill), and U.S. Pat. No. 2,586,524 (Dussardier) each disclose artist's kits.

Other artist's paint boxes are disclosed at various internet sites, including: http://guerrillapainter.com and http://pochade.com.

For the foregoing reasons, there is a need for an artist's paint box system that can be used for watercolor, oil, acrylics, and pastels, that is portable, that may be carried in one hand or removably fastened to a user's wrist or waist, has removably replaceable paint wells, has a removably replaceable palette that is adapted to hold the removably replaceable paint wells, has storage space for a variety of canvases and other materials to paint on and storage space for paintbrushes, has a removably replaceable viewfinder, has a hinged easel for quickly and conveniently mounting and removing canvases and materials to be painted on, and may be removably fastened to a variety of tripods and stands.

The artist's paint box system should allow for mixing of a variety of different paints and types of paints quickly, efficiently, and easily, with a minimum of waste. The artist's paint box system should allow for mounting and removal of canvases and other materials to be painted on quickly and easily, and should be capable of display, access, and retrieval of paintbrushes and tools in a quick, convenient, and efficient manner. Paints, paintbrushes, and tools should be capable of being displayed and distinguished one from the other quickly and easily, and being accessed, used, removed, and stored quickly, and easily. The artist's paint box should be durable, light weight, easy to carry, inexpensive, safe to use, attractive, sturdy, and of simple construction.

SUMMARY

The present invention is directed to an artist's paint box system that can be used for watercolor, oil, acrylics, and pastels, that is portable, that may be carried in one hand or removably fastened to a user's wrist or waist, has removably replaceable paint wells, has a removably replaceable palette that is adapted to hold the removably replaceable paint wells, has storage space for a variety of canvases and other materials to paint on and storage space for paintbrushes, has a removably replaceable viewfinder, has a hinged easel for quickly and conveniently mounting and removing canvases and materials to be painted on, and may be removably fastened to a variety of tripods and stands.

The artist's paint box system allows for mixing of a variety of different paints and types of paints quickly, efficiently, and easily, with a minimum of waste. The artist's paint box system also allows for mounting and removal of canvases and other materials to be painted on quickly and easily, and is capable of display, access, and retrieval of paintbrushes and tools in a quick, convenient, and efficient manner. Paints, paintbrushes, and tools are capable of being displayed and distinguished one from the other quickly and easily, and being accessed, used, removed, and stored quickly, and easily. The artist's paint box is durable, light weight, easy to carry, inexpensive, safe to use, attractive, sturdy, and of simple construction.

An artist's paint box system having features of the present invention comprises: a substantially parallelepiped shaped box having an interior chamber, a combination hinged easel and cover, and a storage compartment having a hinged compartment cover, the substantially parallelepiped shaped box having opposing sides substantially parallel one to the other, a front and a back opposing and substantially parallel one to the other and substantially perpendicular to the opposing sides, a bottom, the combination easel and cover hingedly attached to the back, the hinged compartment cover hingedly attached to the front adjacent the storage compartment, the opposing sides, the front, and the back substantially perpendicular to the bottom; a removably replaceable palette having opposing cutouts substantially parallel to each other and another cutout transverse and substantially perpendicular to the opposing cutouts, a recessed paint color mixing area, and a recessed paintbrush and tool holding area, the opposing cutouts and the transverse cutout forming a substantially U shape, the removably replaceably palette having opposing edges adjacent each of the opposing cutouts and other opposing edges adjacent the transverse cutout, the removably replaceable palette matingly received within the chamber of the substantially parallelepiped shaped box, the recessed paint color mixing area adjacent the opposing cutouts and the transverse cutout and substantially centrally disposed between the opposing cutouts, the recessed paintbrush and tool holding area adjacent the transverse cutout opposing the paint color mixing area, the storage compartment between the removably replaceable palette and the bottom; removably replaceable paint wells removably and matingly received within the opposing cutouts and the transverse cutout, each of the removably replaceable paint wells having a paint container portion and a hinged paint well cover hingedly attached to the paint container portion, the paint container portion having exteriorly disposed opposing side ridges, the exteriorly disposed opposing side ridges of the removably replaceable paint wells resting on the opposing edges adjacent each of the opposing cutouts and resting on the other opposing edges adjacent the transverse cutout of the removably replaceable palette.

DRAWINGS

These and other features, aspects, and advantages of the present invention will become better understood with regard to the following description, appended claims, and accompanying drawings where:

DESCRIPTION

Figure 1:
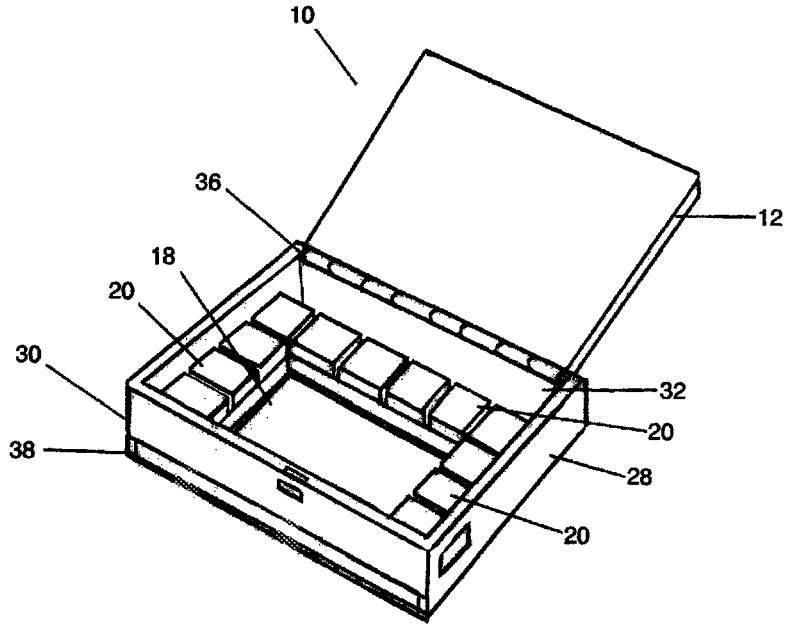
FIG. 1 is a perspective view of an artist's paint box showing the artist's paint box open, constructed in accordance with the present invention.
Figure 2:
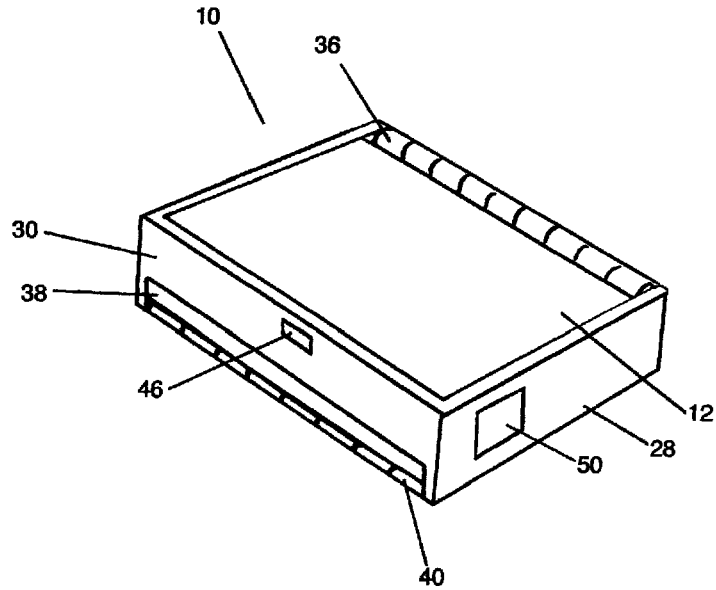
FIG. 2 is a perspective view of the artist's paint box of FIG. 1 showing the artist's paint box closed.
Figure 3:
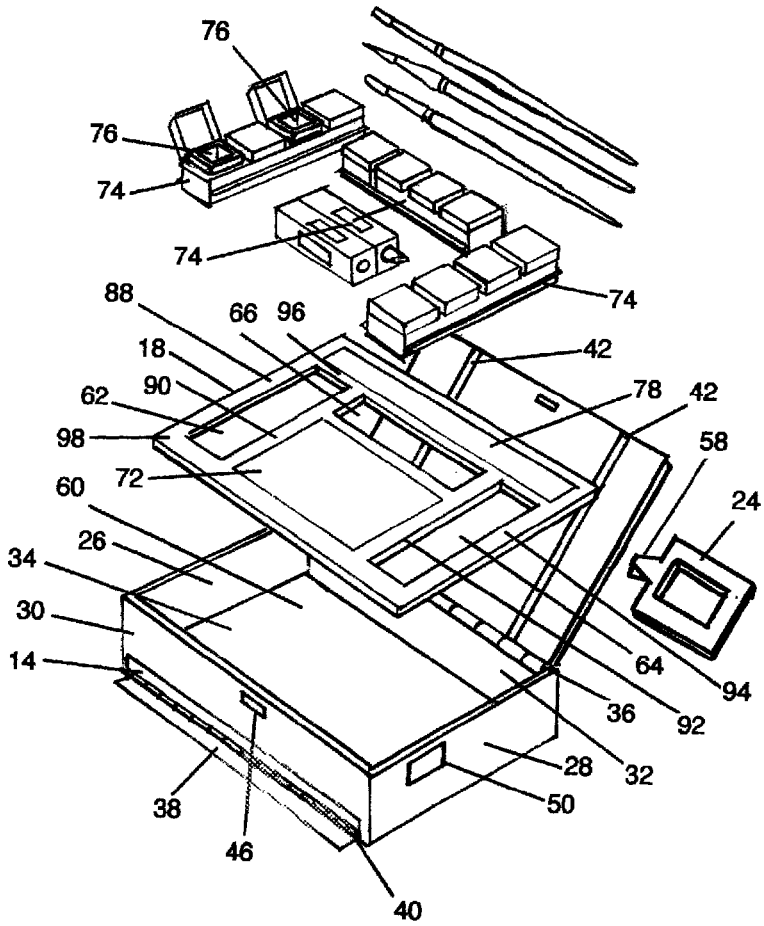
FIG. 3 is an exploded view of the artist's paint box of FIG. 1 showing the artist's paint box open.
Figure 4:
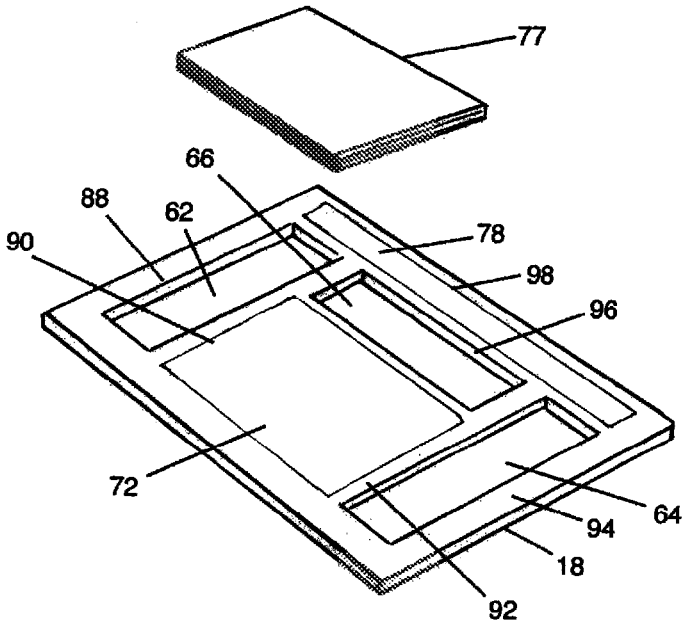
FIG. 4 is a perspective view of a palette and an optional disposable palette pad of the artist's paint box of FIG. 1
Figure 5:
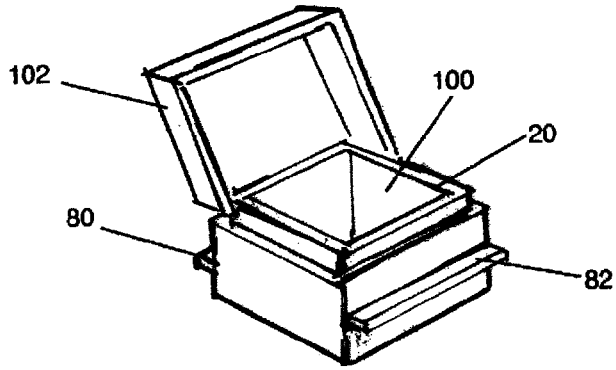
FIG. 5 is a perspective view of a paint well of the artist's paint box of FIG. 1.
Figure 6:
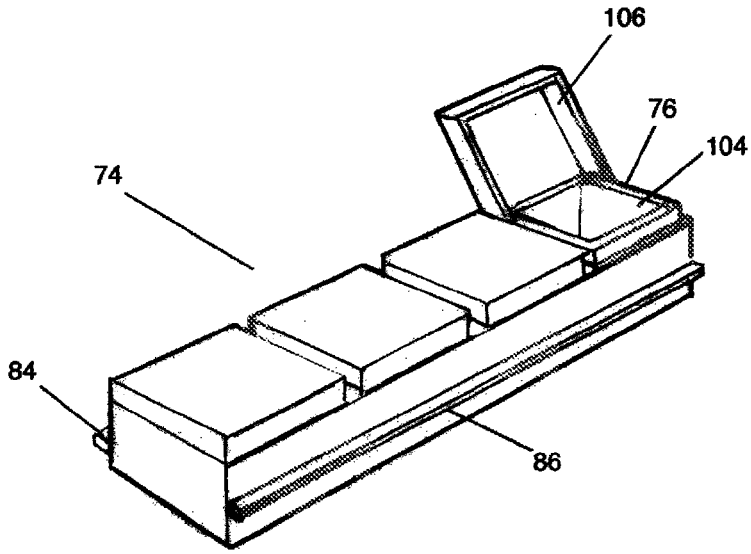
FIG. 6 is a perspective view of a paint well module, comprising a plurality of paint wells, of the artist's paint box of FIG. 1.
Figure 7:
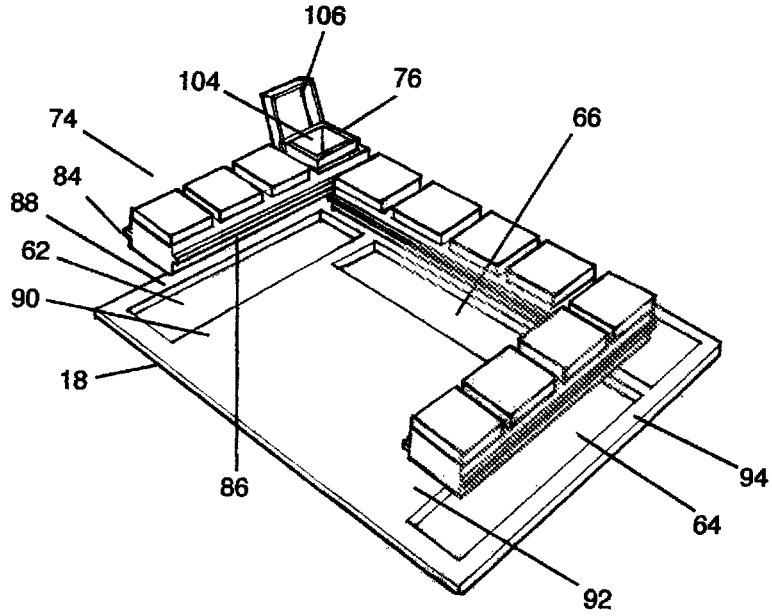
FIG. 7 is an exploded view of the palette and the paint well modules of FIGS. 4 and 6, respectively.
Figure 8:
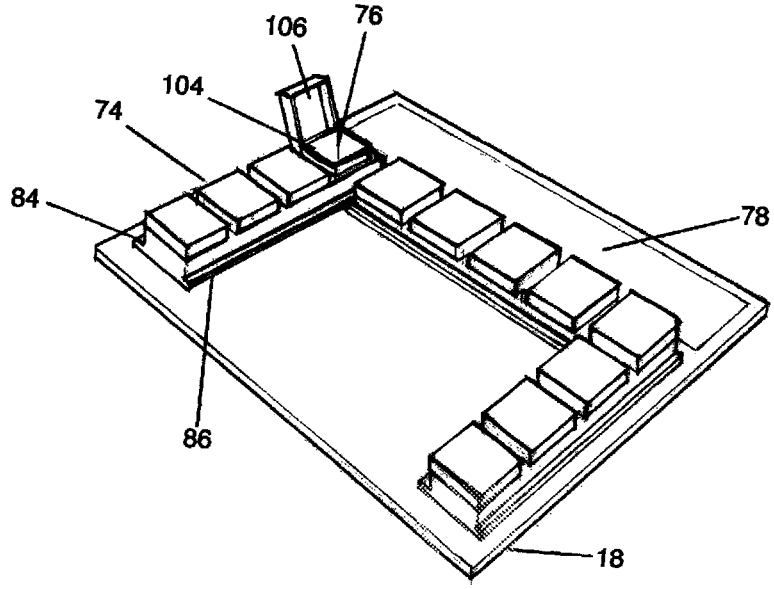
FIG. 8 is a perspective view of the palette and the paint well modules of FIGS. 4 and 6, respectively, having the paint well modules mounted in the palette.
Figure 9:
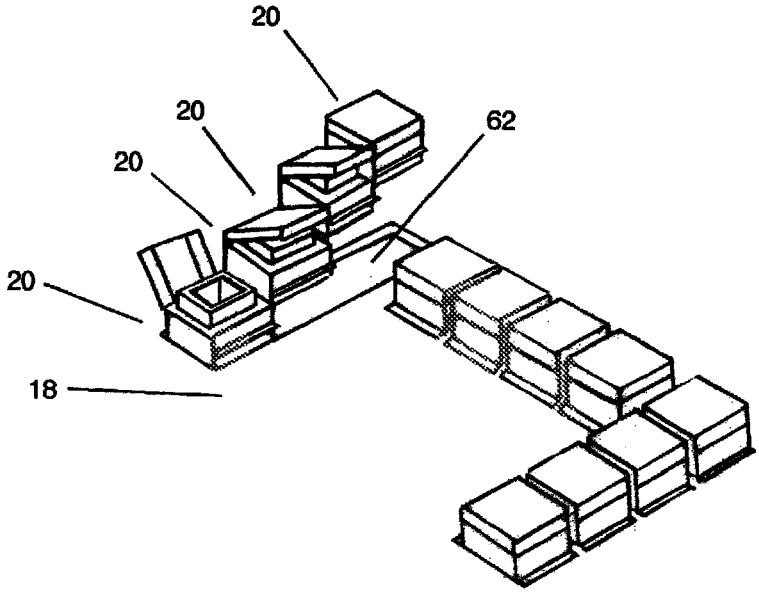
FIG. 9 is a perspective view of a plurality of the paint wells of FIG. 5 and a plurality of the paint well modules of FIG. 6, showing a portion of the palette of FIG. 4.
Figure 10:
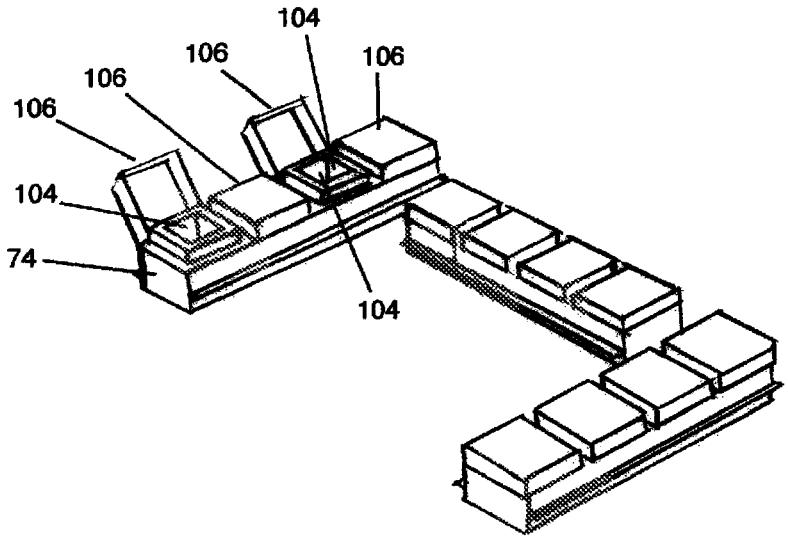
FIG. 10 is a perspective view of a plurality of the paint well modules of FIG. 6.
Figure 11:
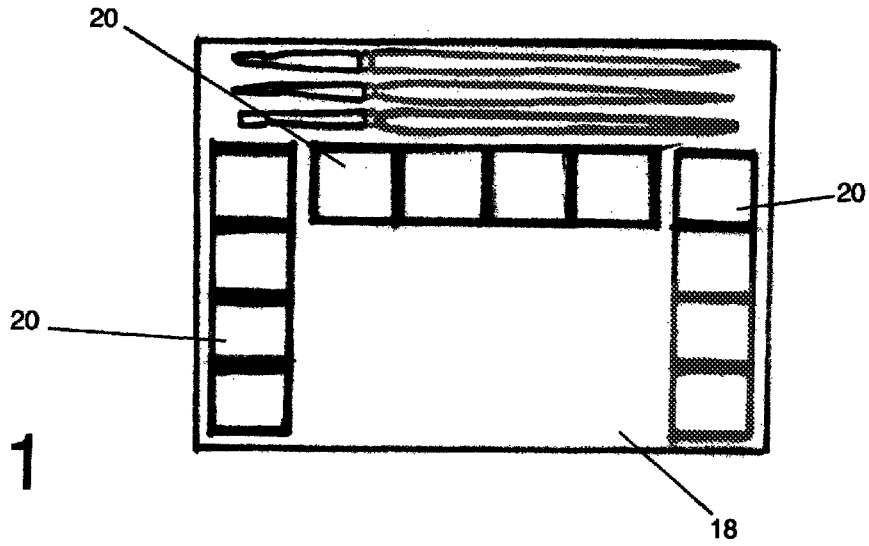
FIG. 11 is a top view of the palette of FIG. 6, the paint well modules of FIG. 4 mounted in the palette, and paintbrushes resting on the palette.

The preferred embodiments of the present invention will be described with reference to FIGS. 1-26 of the drawings. Identical elements in the various figures are identified with the same reference numbers.

FIGS. 1-19 show an embodiment of the present invention, an artist's paint box 10 having combination hinged easel and cover 12, storage compartment 14, removably replaceable palette 18, removably replaceable paint wells 20, spray and water/medium bottles 22 and 23, respectively, and viewfinder 24.

The artist's paint box 10 is of substantially parallelepiped shape having opposing sides 26 and 28, front 30 and back 32 opposing one another, bottom 34, the combination hinged easel and cover 12 hingedly attached to the back 32 at hinge 36, hinged storage compartment cover 38 hingedly attached to the front 30 at hinge 40, the hinged storage compartment cover 38 protecting canvases and materials to be painted on and/or already painted on materials from exiting the storage compartment 14, unless opened by the artist, and which acts as a cover for the storage compartment 14. The storage compartment 14 is between the removably replaceable palette 18 and the bottom 34. The opposing sides 26 and 28 are substantially perpendicular to the front 30 and the back 32, each of which are substantially perpendicular to the bottom 34 and the combination hinged easel and cover 12, when the artist's paint box 10 is closed. The combination hinged easel and cover 12 has putty strips 42 releasably and adhesively fastened to the combination hinged easel and cover 12 for releasably and removably mounting the artist's canvas or material to be painted on thereto.

The combination hinged easel and cover 12 has lock bolt 44 and the front 30 has lock release 46, the lock bolt 44 and the lock release 46 releasably locking the combination hinged easel and cover 12 to the front 30 of the artist's paint box 10, when the artist's paint box 10 is not in use and/or when the artist's paint box 10 is stored, and, thus, maintaining the artist's paint box 10 closed, as may be required by the artist.

The spray and water/medium bottles 22 and 23, respectively, have hook and loop fasteners 48 attached thereto. The opposing sides 26 and 28 of the artist's paint box 10 have hook and loop fasteners 50, for removably attaching the spray and water/medium bottles 22 and 23, respectively, thereto, by removably fastening the hook and loop fasteners 48 of the spray and water/medium bottles 22 and 23, respectively, to the hook and loop fasteners 50 of the opposing sides 26 and 28.

Figure 17:
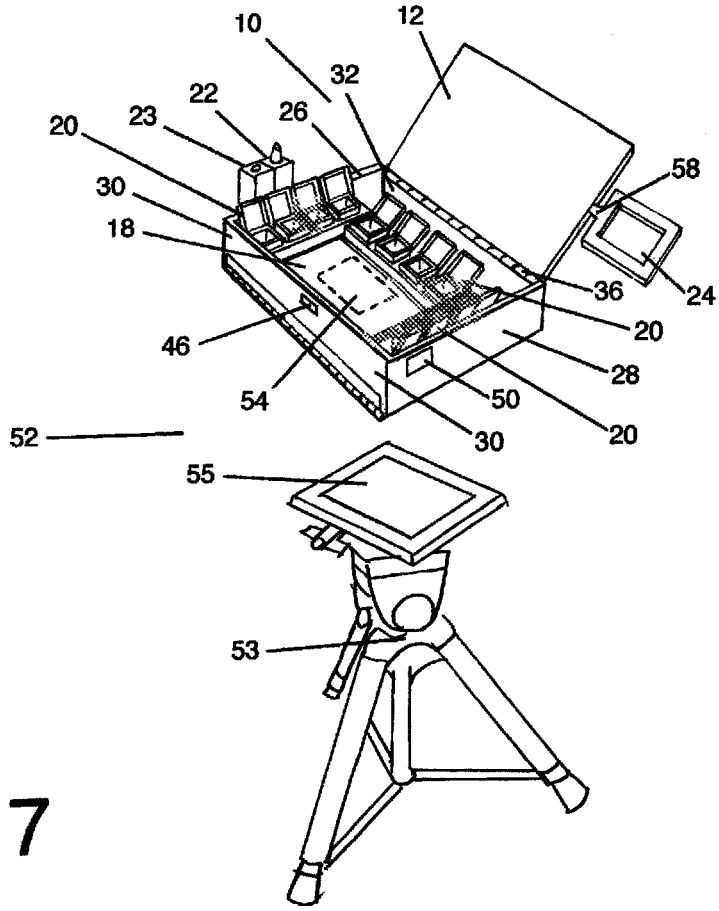
FIG. 17 is a perspective view of an artist's paint box system showing the artist's paint box of FIG. 1 open and an accessory tripod.
Figure 18:
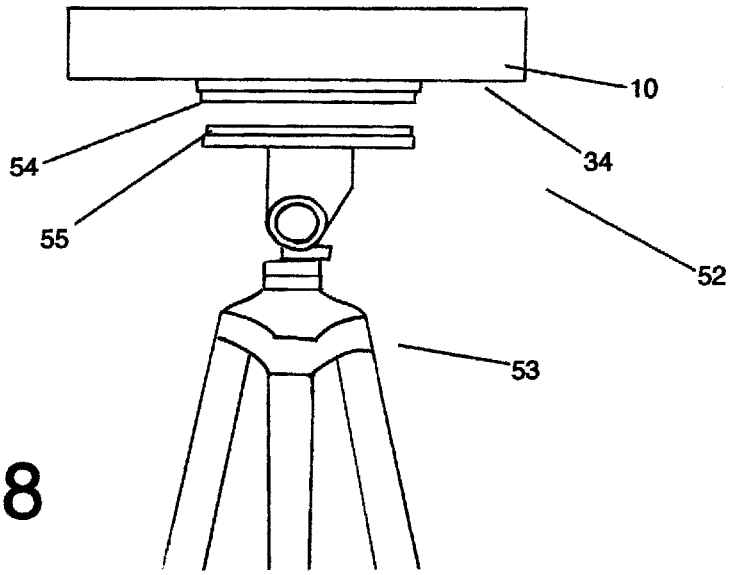
FIG. 18 is a side view of the artist's paint box system of FIG. 17 showing the artist's paint box closed.

FIGS. 17 and 18 show an artist's paint box system 52 having the artist's paint box 10 and tripod 53. The bottom 34 of the artist's paint box 10 has removable hook and loop fasteners 54 removably fastened to the bottom 34 of the artist's paint box 10 for removably attaching the artist's paint box 10 to hook and loop fasteners 55 of the tripod 53 of the artist's paint box system 52, as shown in FIGS. 17 and 18, or releasably attaching the artist's paint box 10 to another suitable surface. The artist's paint box 10 may, however, have other suitable fasteners, or the removably hook and loop fasteners 54 may be removed from the bottom 34 of the artist's paint box 10 for placing the artist's paint box 10 on another surface, such as a table or other suitable surface.

The viewfinder 24 has clip 58 for removably attaching the viewfinder 24 to the combination hinged easel and cover 12, the opposing sides 26 or 28 of the front 30 of the artist's paint box 10 or other suitable surface.

The artist's paint box 10 has chamber 60 for matingly receiving and storing the removably replaceable palette 18, the removably replaceable paint wells 20, the spray and water/medium bottles 22 and 23, respectively, tools and paintbrushes 44, and the viewfinder 24, when the artist's paint box 10 is not in use.

The removably replaceable palette 18 is substantially rectangular in shape, removably and replaceably drops into, and matingly fits in the chamber 60 of the artist's paint box. The removably replaceable palette 18 is matingly received within the chamber 60, and is inserted into the chamber 60 by dropping the removably replaceable palette 18 into the chamber 60.

The removably replaceable palette 18 has opposing cutouts 62 and 64 opposing one another and substantially parallel to each other and transverse cutout 66 transverse to and perpendicular to the opposing cutouts 62 and 64, the opposing cutouts 62 and 64 and the transverse cutout 66 forming a substantially U shape, with opposing cutouts 62 and 64 forming the sides of the U, and the transverse cutout 66 forming the base of the U.

The removably replaceable palette 18 has recessed paint color mixing area 72 for mixing paints, such as those paints stored in the removably replaceable paint wells 20 and/or stored in removably replaceable paint well modules 74, which comprise a plurality of paint wells 76 or other suitable paints. The recessed paint color mixing area 72 is adjacent the opposing cutouts 62 and 64 and the transverse cutout 66, is substantially centrally disposed between the opposing cutouts 62 and 64, and is adapted to accommodate a disposable palette pad 77, which may also and/or alternatively be used for mixing paints. The removably replaceable palette 18 also has recessed tool and/or paintbrush holding area 78 adjacent the transverse cutout 66 and opposing the paint color mixing area 72.

The removably replaceable paint wells 20 have exteriorly disposed opposing side ridges 80 and 82 and the paint well modules 74, which may alternatively be used, comprising the plurality of paint wells 76, have exteriorly disposed opposing side ridges 84 and 86.

The removably replaceable palette 18 has opposing edges 88 and 90, opposing edges 92 and 94, and opposing edges 96 and 98 adjacent the opposing cutouts 62 and 64 and the transverse cutout 66, respectively.

The removably replaceable paint wells 20 and/or the removably replaceable paint well modules 74 are matingly removably placed, inserted, and dropped into the opposing cutouts 62 and 64 and the transverse cutout 66 with the opposing side ridges 80 and 82 of the removably replaceable paint wells 20 and/or the opposing side ridges 84 and 86 of the removably replaceable paint well modules 74 resting on the opposing edges 88 and 90, the opposing edges 92 and 94, and the opposing edges 96 and 98 of the removably replaceable palette 18, thus, holding the removably replaceable paint wells 20 and/or the removably replaceable paint well modules 74 in place in the removably replaceable palette 18.

Each of the removably replaceable paint wells 20 have paint container portion 100 and hinged paint well cover 102, which may optionally be removed from the container portion 100. Each of the plurality of paint wells 76 of the removably replaceable paint well modules 74 have container portions 104 and hinged paint well module covers 106, which may be optionally removed from the container portions 104. The removably replaceable paint well modules 74 may have the hinged covers 106 fastened one to the other or the hinged covers 106 may be separate.

Figure 12:
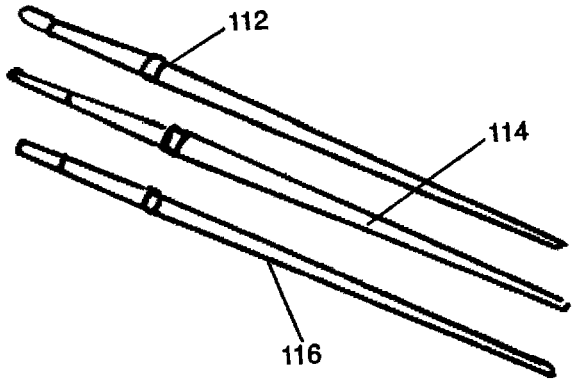
FIG. 12 is a perspective view of the paintbrushes of FIG. 11.
Figure 13:
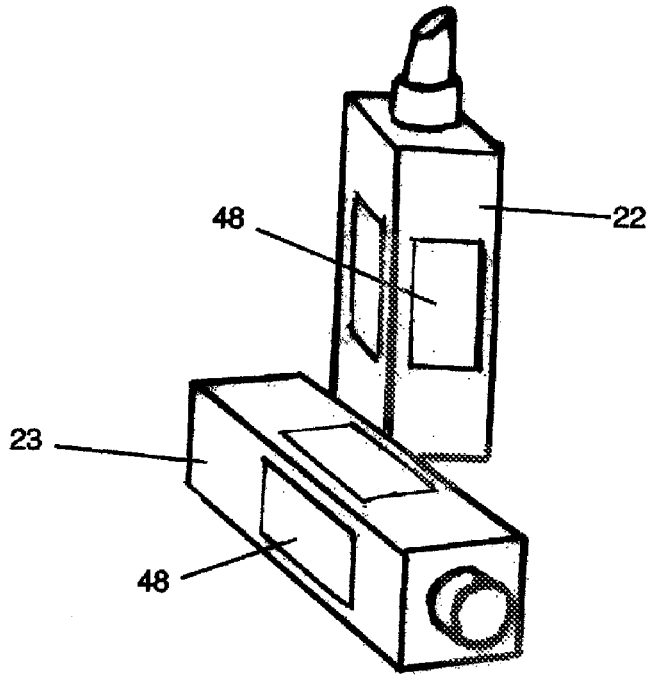
FIG. 13 is a perspective view of spray bottles and medium containers of the artist's paint box of FIG. 1.
Figure 14:
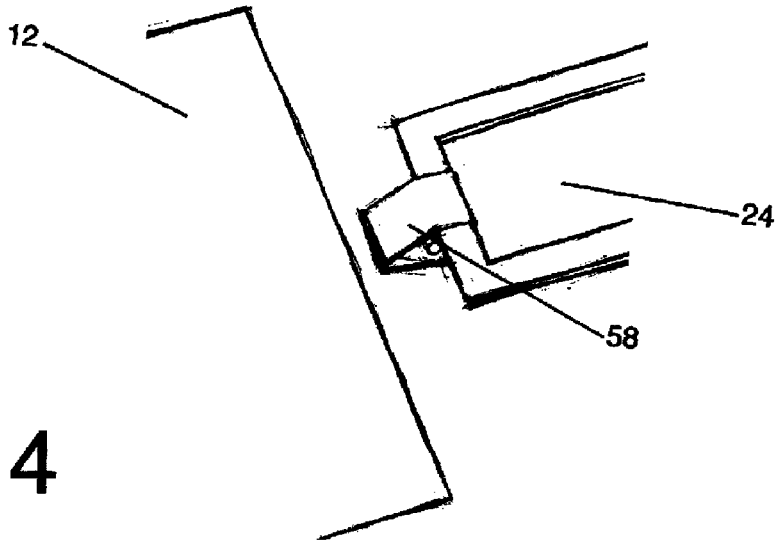
FIG. 14 is a perspective view of a portion of a viewfinder of the artist's paint box of FIG. 1 and a portion of the artist's paint box.
Figure 15:
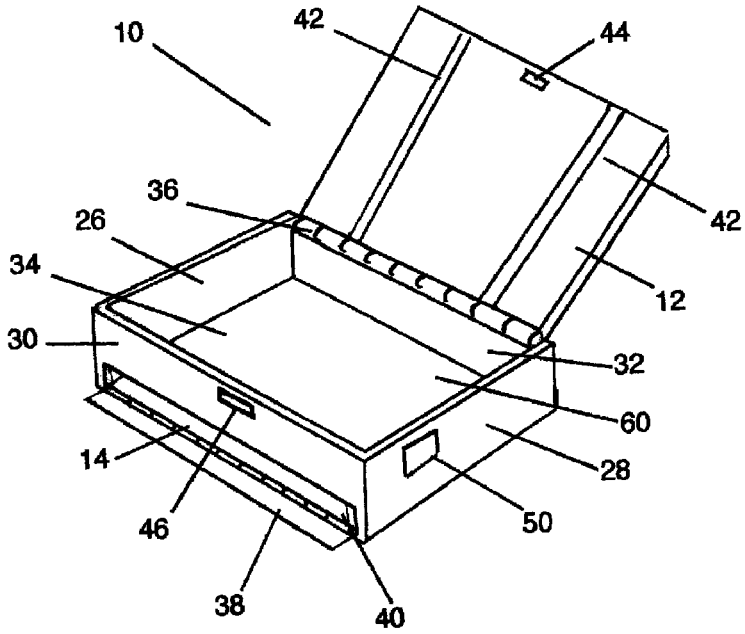
FIG. 15 is another perspective view of the artist's paint box of FIG. 1 showing the artist's paint box open.
Figure 16:
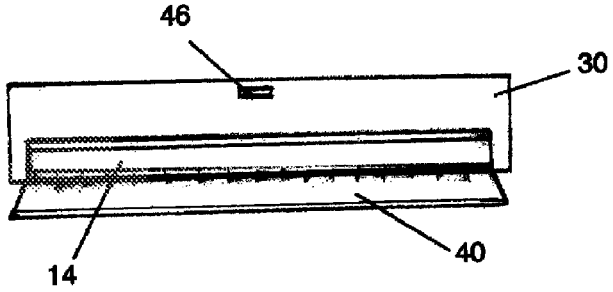
FIG. 16 is a front view of the artist's paint box of FIG. 1 showing the artist's paint box open and a storage compartment of the artist's paint box open.

FIG. 12 shows a filbert paintbrush 112, a round paintbrush 114, and a flat paintbrush 116, although other suitable paintbrushes may be used.

The artist's paint box 10 may be of plastics, glass, thermoplastics, thermosetting polymers, transparent thermoplastics, rubber, wood, metal, such as aluminum, copper, brass, or steel, or other suitable material or combination thereof.

Figure 19:
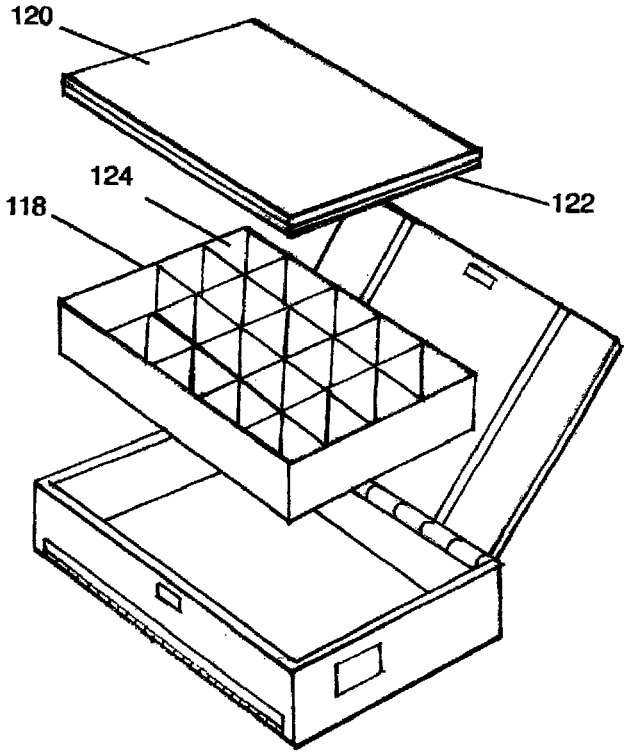
FIG. 19 is an exploded view of the artist's paint box showing an accessory pastel paint tray.
Figure 20:
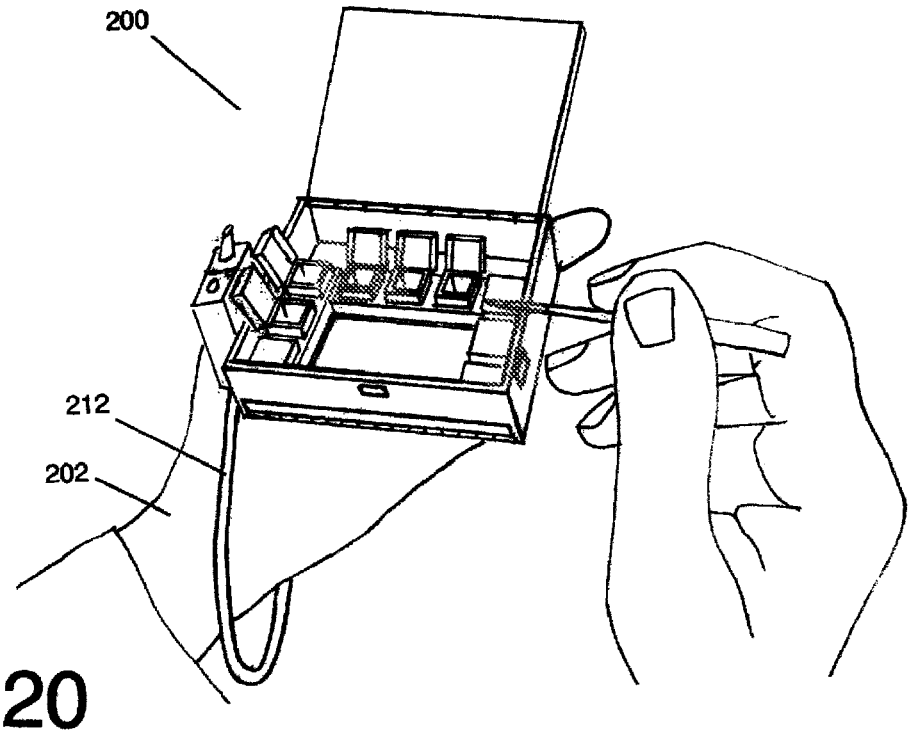
FIG. 20 is a perspective view of an alternate embodiment of an artist's paint box, which may be held in one of the artist's hands while the artist is painting with the other hand, and which may be carried on the artist's wrist, showing the artist's paint box open.
Figure 21:
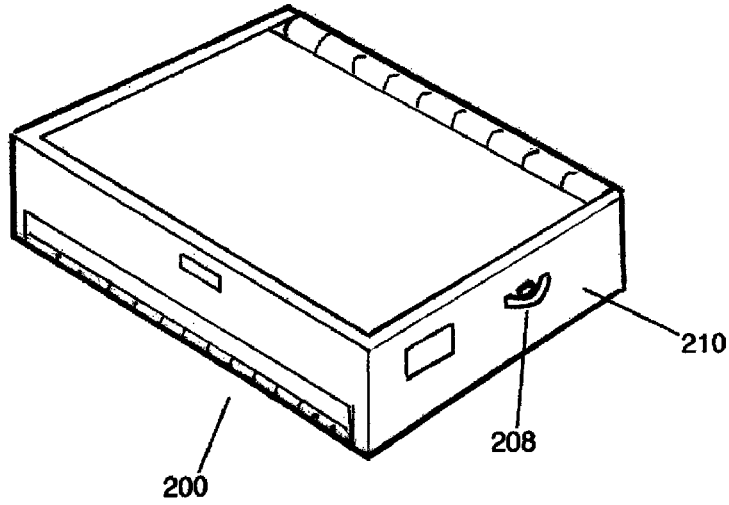
FIG. 21 is a perspective view of the artist's paint box of FIG. 20 showing the artist's paint box closed.
Figure 22:
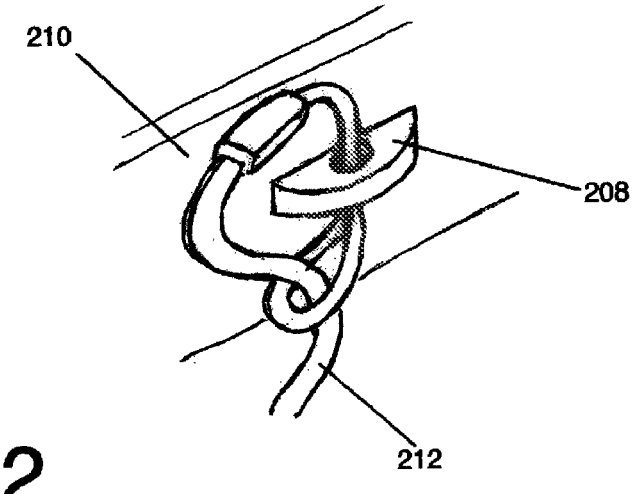
FIG. 22 is a perspective view of a portion of the artist's paint box of FIG. 20 showing an eye and a portion of a carrying strap looped through the eye.
Figure 23:
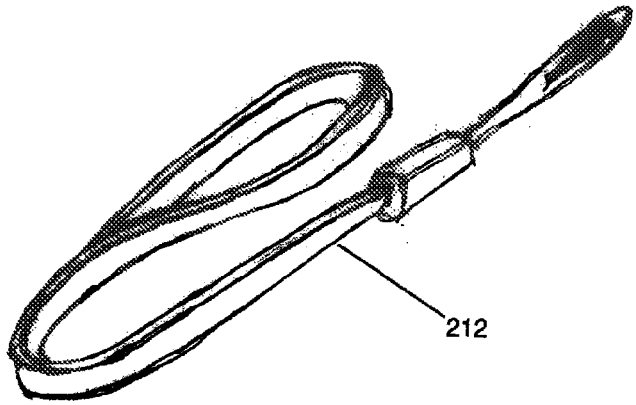
FIG. 23 is a perspective view of the carrying strap of FIG. 22.
Figure 24:
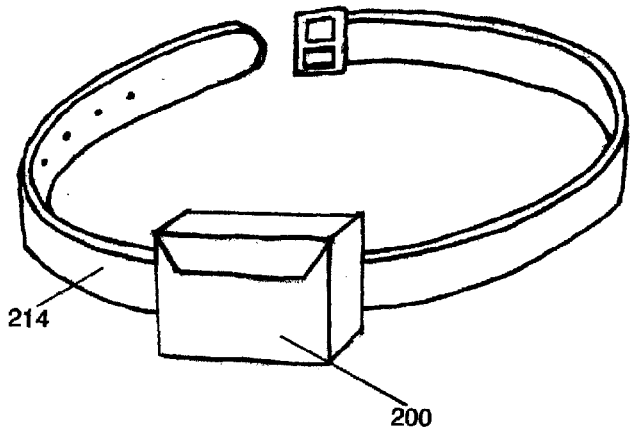
FIG. 24 is a perspective view of an accessory wrist band, strap or belt and the artist's paint box of FIG. 20 mounted to the wrist band, strap or belt, which the user may removably fasten to the user's wrist or waist.

FIG. 19 shows the artist's paint box 10 having an accessory compartmentalized pastel tray 118 for organizing, transporting, storing, and accessing artist's pastels, the compartmentalized pastel tray 118 having tray cover 120 and resilient sponge liner pad 122, which protectively cushions and immobilizes the artist's pastels, when the artist's paint box 10 is closed, and compartments 124.

FIGS. 20-24 show an alternative embodiment of an artist's paint box 200, which is substantially the same as the artist's paint box 10, except that the artist's paint box 10 may be carried in an artist's pocket or purse, or alternatively carried on an artist's wrist 202 and/or removably fastened to the artist's wrist 202 or waist. The artist's paint box 200 has eye 208 fastened to side 210 of the artist's paint box 200, and removable carrying strap 212, which may be removably attached to the artist's wrist 202. The artist's paint box 200 may alternatively be removably mounted to belt, wristband, or wrist strap 214, which may be removably fastened to the artist's wrist 202 or waist.

Figure 25:
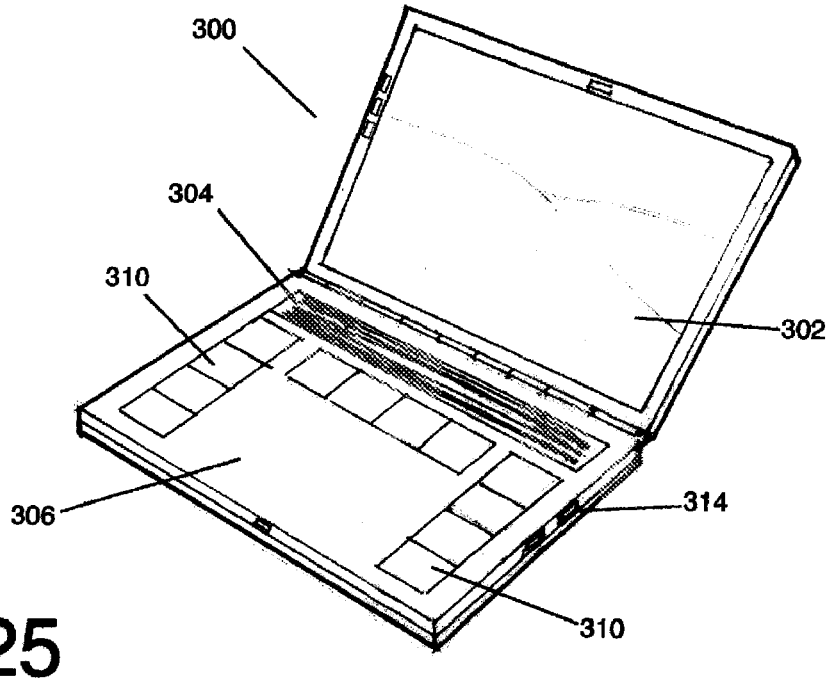
FIG. 25 is a perspective view of an alternate embodiment of an artist's paint box in digital form.
Figure 26:
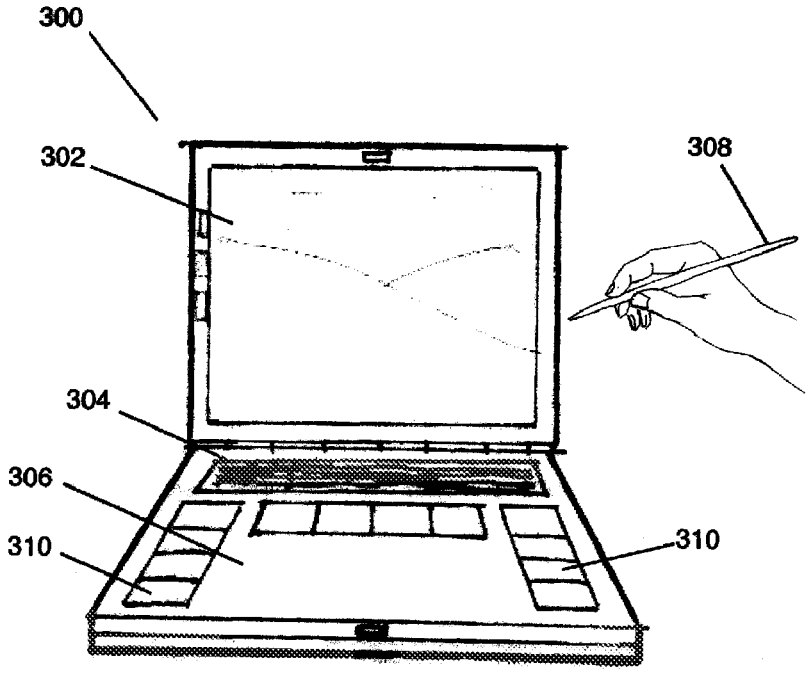
FIG. 26 is another perspective view of the artist's paint box of FIG. 25.

FIGS. 25 and 26 show an alternate embodiment of an artist's paint box 300 in digital form, which comprises a digital drawing and paint studio simulator, which may be used to produce artwork and represent actions possible by the artist, similar to those produced by the artist when using the artist's paint box 10 and/or the artist's paint box 200, and uses personal computer components and software to aid in the digital drawing and paint studio simulator experience.

The artist's paint box 300 has a pressure sensitive tablet/touch screen 302, digital paintbrush/pencil box 304, pressure sensitive mixing palette 306, stylus 308, pressure sensitive paint wells 310, printer connection 314, and is powered by a battery.

The artist's paint box 300 is efficient, consumes minimum power, and may be solar powered. The stylus 308 is used directly on the pressure sensitive tablet/touch screen 302, and paint is mixed digitally directly on the pressure sensitive mixing palette 306.

The artist's paint box 300 provides all the intuitiveness of pen and paper and paintbrush and canvas. A variety of brush styles and sizes, as well pencil and charcoal types are available in the software of the artist's paint box 300.

The artist's paint box has pressure sensitive surfaces on the pressure sensitive tablet/touch screen 302 and pressure sensitive surfaces on the mixing palette 306, which may be activated by the amount of pressure of the stylus 306 against the appropriate surface.

The artist's paint box 300 enables the artist to use natural eye-hand coordination to work intuitively with the artist's paint box 300 and its associated software.

Although the present invention has been described in considerable detail with reference to certain preferred versions thereof, other versions are possible. Therefore, the spirit and scope of the appended claims should not be limited to the description of the preferred versions contained herein.

What is claimed is:

1. An artist's handheld paint box, comprising:

a rectangular parallelepiped shaped box, a removably replaceable rectangular substantially flat board shaped combination drop-in palette, paint container holder, and combination paint brush and paint tool holder, and a plurality of removably replaceable drop-in paint containers;

said rectangular parallelepiped shaped box comprising:

a rectangular parallelepiped shaped interior chamber, a rectangular flat upper front wall panel, a rectangular flat back wall panel substantially parallel to and opposing said rectangular flat upper front wall panel, a rectangular flat bottom panel having a lower front hinged flat door panel hingedly attached thereto at a front edge thereof, said lower front hinged flat door panel in an upright position substantially aligned with said rectangular flat upper front wall panel when closed, said rectangular parallelepiped shaped box adapted to removably receive at least one paint sheet within said rectangular parallelepiped shaped interior chamber when said lower front hinged flat door panel is opened, a hinged rectangular flat top panel combination easel and cover hingedly attached to said rectangular flat back wall panel at a top edge thereof, said hinged rectangular flat top panel combination easel and cover substantially parallel to said rectangular flat bottom panel when closed, said hinged rectangular flat top panel combination easel and cover having an easel at an underside thereof that is exposed when opened, opposing rectangular flat side wall panels substantially parallel one to the other, said opposing rectangular flat side wall panels attached to and substantially perpendicular to said rectangular flat bottom panel and said rectangular flat back wall panel and said rectangular flat upper front wall panel;

said removably replaceable rectangular substantially flat board shaped combination drop-in palette, paint container holder, and combination paint brush and paint tool holder adapted to be removably and matingly received within said rectangular parallelepiped shaped interior chamber, said removably replaceable rectangular substantially flat board shaped combination drop-in palette, paint container holder, and combination paint brush and paint tool holder resting on said rectangular flat bottom panel in the absence of said at least one paint sheet and resting on said at least one paint sheet in the presence of said at least one paint sheet resting on said rectangular flat bottom panel within said rectangular parallelepiped shaped interior chamber, said removably replaceable rectangular substantially flat board shaped combination drop-in palette, paint container holder, and combination paint brush and paint tool holder having a substantially rectangular sunken-relief paint mixing palette, an oblong sunken-relief combination paint brush and paint tool holder, and a plurality of paint container holder receiving holes adapted to removably receive said plurality of removably replaceable drop-in paint containers, said plurality of paint container holder receiving holes comprising opposing substantially rectangular holes substantially parallel to each other and another substantially rectangular hole transverse and substantially perpendicular to said opposing substantially rectangular holes, said opposing substantially rectangular holes and said transverse substantially rectangular hole forming a substantially U shaped hole arrangement about said substantially rectangular sunken-relief paint mixing palette said oblong sunken-relief combination paint brush and paint tool holder adjacent said transverse substantially rectangular hole;

said plurality of removably replaceable drop-in paint containers having hinged lids and having opposing side ridges adapted to rest on opposing edges of said plurality of paint container holder receiving holes.

2. The artist's handheld paint box according to claim 1, wherein:

said removably replaceable rectangular substantially flat board shaped combination drop-in palette, paint container holder, and combination paint brush and paint tool holder matingly received within said rectangular parallelepiped shaped interior chamber and inserted into said rectangular parallelepiped shaped interior chamber by dropping said removably replaceable rectangular substantially flat board shaped combination drop-in palette, paint container holder, and combination paint brush and paint tool holder into said rectangular parallelepiped shaped interior chamber.

3. The artist's handheld paint box according to claim 1, wherein:

said rectangular parallelepiped shaped interior chamber is adapted to removably store said at least one paint sheet comprising at least one artist's canvas therein.

4. The artist's handheld paint box according to claim 1, wherein:

said plurality of removably replaceable drop-in paint containers comprise at least one removably replaceable drop-in paint container module comprising at least one of said plurality of removably replaceable drop-in paint containers.

5. The artist's handheld paint box according to claim 1, wherein:

said plurality of removably replaceable drop-in paint containers matingly received within said opposing substantially rectangular holes and said transverse substantially rectangular hole and inserted into said opposing substantially rectangular holes and said transverse substantially rectangular hole by inserting and dropping said plurality of removably replaceable drop-in paint containers into said opposing substantially rectangular holes and said transverse substantially rectangular hole into said chamber.

6. The artist's handheld paint box according to claim 5, wherein:

said removably replaceable rectangular substantially flat board shaped combination drop-in palette, paint container holder, and combination paint brush and paint tool holder matingly received within said rectangular parallelepiped shaped interior chamber and inserted into said rectangular parallelepiped shaped interior chamber by dropping said removably replaceable rectangular substantially flat board shaped combination drop-in palette, paint container holder, and combination paint brush and paint tool holder into said rectangular parallelepiped shaped interior chamber.

7. The artist's handheld paint box according to claim 6, wherein:

said rectangular parallelepiped shaped interior chamber is adapted to removably store said at least one paint sheet comprising at least one artist's canvas therein.

8. The artist's handheld paint box according to claim 1, wherein:

said hinged rectangular flat top panel combination easel and cover has a plurality of putty strips releasably and adhesively fastened to said hinged rectangular flat top panel combination easel and cover for releasably and removably mounting an artist's canvas thereto.

9. The artist's handheld paint box according to claim 1, wherein:

said rectangular flat bottom panel has bottom hook and loop fasteners.

10. The artist's handheld paint box according to claim 9, wherein:

said artist's handheld paint box further comprises a tripod having tripod hook and loop fasteners;

said artist's handheld paint box is removably fastened to said tripod at said bottom hook and loop fasteners and said tripod hook and loop fasteners.

11. The artist's handheld paint box according to claim 1, wherein:

at least one of said opposing rectangular flat side wall panels has side hook and loop fasteners.

12. The artist's handheld paint box according to claim 11 wherein:

said artist's handheld paint box further comprises at least one bottle having bottle hook and loop fasteners;

said at least one bottle is removably fastened to said artist's handheld paint box at said side hook and loop fasteners and said bottle hook and loop fasteners.

13. The artist's handheld paint box according to claim 1, wherein:

said artist's handheld paint box has a disposable palette pad removably mounted on said rectangular sunken-relief paint mixing palette.

14. The artist's handheld paint box according to claim 1, wherein:

said rectangular flat bottom panel has bottom hook and loop fasteners and at least one of said opposing rectangular flat side wall panels has side hook and loop fasteners;

said artist's handheld paint box further comprises a tripod having tripod hook and loop fasteners and at least one bottle having bottle hook and loop fasteners;

said artist's handheld paint box is removably fastened to said tripod at said bottom hook and loop fasteners and said tripod hook and loop fasteners;

said at least one bottle is removably fastened to said artist's handheld paint box at said side hook and loop fasteners and said bottle hook and loop fasteners.

15. The artist's handheld paint box according to claim 7, wherein:

said rectangular flat bottom panel has bottom hook and loop fasteners and at least one of said opposing rectangular flat side wall panels has side hook and loop fasteners;

said artist's handheld paint box further comprises a tripod having tripod hook and loop fasteners and at least one bottle having bottle hook and loop fasteners;

said artist's handheld paint box is removably fastened to said tripod at said bottom hook and loop fasteners and said tripod hook and loop fasteners;

said at least one bottle is removably fastened to said artist's handheld paint box at said side hook and loop fasteners and said bottle hook and loop fasteners.

16. The artist's handheld paint box according to claim 1, wherein:

said artist's handheld paint box further comprises a viewfinder having a clip, said viewfinder removably fastened to said artist's handheld paint box with said clip.

17. The artist's handheld paint box according to claim 1, wherein:

said artist's handheld paint box has an eye and a removable carrying strap removably fastened to said artist's handheld paint box through said eye.

18. The artist's handheld paint box according to claim 1, wherein:

said artist's handheld paint box further comprises a wristband, said artist's handheld paint box removably fastened to said wristband.

19. The artist's handheld paint box according to claim 1, wherein said removably replaceable rectangular substantially flat board shaped combination drop-in palette, paint container holder, and combination paint brush and paint tool holder is constructed of glass.

* * * * *